US011582557B2

(12) United States Patent
Koyanagi et al.

(10) Patent No.: US 11,582,557 B2
(45) Date of Patent: Feb. 14, 2023

(54) SPEAKER DIAPHRAGM, SPEAKER, SPEAKER DIAPHRAGM MANUFACTURING METHOD, ELECTRONIC DEVICE, AND MOBILE BODY APPARATUS

(71) Applicant: Panasonic Intellectual Property Management Co., Ltd., Osaka (JP)

(72) Inventors: Tetsuya Koyanagi, Osaka (JP); Tetsushi Itano, Osaka (JP); Kazuaki Nishimura, Okayama (JP); Makoto Kurozawa, Mie (JP); Ryouichi Uemoto, Osaka (JP); Hiroki Sano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/211,114

(22) Filed: Mar. 24, 2021

(65) Prior Publication Data

US 2021/0306755 A1 Sep. 30, 2021

(30) Foreign Application Priority Data

Mar. 31, 2020 (JP) ..... JP2020-063559

(51) Int. Cl.

| | |
|---|---|
| ***H04R 7/12*** | (2006.01) |
| ***H04R 7/20*** | (2006.01) |
| ***H04R 31/00*** | (2006.01) |

(52) U.S. Cl.

CPC ..... *H04R 7/12* (2013.01); *H04R 7/20* (2013.01); *H04R 31/003* (2013.01); *H04R 2307/00* (2013.01); *H04R 2307/204* (2013.01); *H04R 2499/13* (2013.01)

(58) Field of Classification Search

CPC ..... H04R 7/12

See application file for complete search history.

(56) References Cited

U.S. PATENT DOCUMENTS

| | | | | |
|---|---|---|---|---|
| 5,521,886 | A * | 5/1996 | Hirosawa | H04R 31/003 367/174 |
| 9,668,058 | B2 | 5/2017 | Matsumura et al. | |
| 9,894,443 | B2 | 2/2018 | Honda | |
| 9,961,449 | B2 | 5/2018 | Honda et al. | |
| 10,327,085 | B2 | 6/2019 | Hiraoka | |
| 10,375,478 | B2 | 8/2019 | Konno et al. | |
| 10,405,119 | B2 | 9/2019 | Hiraoka | |
| 10,477,290 | B2 | 11/2019 | Kuribayashi et al. | |
| 10,484,794 | B2 | 11/2019 | Itano et al. | |
| 10,506,335 | B2 | 12/2019 | Kagawa et al. | |
| 10,645,509 | B2 | 5/2020 | Itano et al. | |
| 10,708,693 | B2 | 7/2020 | Shibuya et al. | |
| 10,715,897 | B2 | 7/2020 | Uemoto et al. | |

(Continued)

FOREIGN PATENT DOCUMENTS

| | | | |
|---|---|---|---|
| GB | 2251204 A | * | 1/1992 |
| JP | 64-000896 A | | 1/1989 |
| JP | 2011-239248 A | | 11/2011 |

*Primary Examiner* — Andrew L Sniezek

(74) *Attorney, Agent, or Firm* — Greenblum & Bernstein, P.L.C.

(57) ABSTRACT

A speaker diaphragm includes an edge formed from an elastomer, and a diaphragm body that is to be joined to the edge. A joint between the edge and the diaphragm body includes a melting portion between the edge and the diaphragm body.

7 Claims, 7 Drawing Sheets

(56) References Cited

U.S. PATENT DOCUMENTS

| | | | | |
|---|---|---|---|---|
| 10,824,187 | B2 * | 11/2020 | Sakai | G06F 1/10 |
| 2002/0061117 | A1 * | 5/2002 | Takewa | H04R 31/003 381/430 |
| 2008/0159583 | A1 * | 7/2008 | Tanaka | H04R 7/14 381/398 |
| 2013/0259291 | A1 * | 10/2013 | Fujitani | H04R 7/18 381/423 |
| 2013/0315435 | A1 * | 11/2013 | Sato | H04R 7/16 181/171 |
| 2017/0180868 | A1 | 6/2017 | Kuze et al. | |
| 2017/0280248 | A1 | 9/2017 | Kuze et al. | |
| 2018/0270596 | A1 | 9/2018 | Hiraoka | |
| 2018/0288531 | A1 | 10/2018 | Kagawa et al. | |
| 2020/0228900 | A1 | 7/2020 | Hiraoka et al. | |
| 2020/0245072 | A1 | 7/2020 | Miyamoto et al. | |

* cited by examiner

SPEAKER DIAPHRAGM, SPEAKER, SPEAKER DIAPHRAGM MANUFACTURING METHOD, ELECTRONIC DEVICE, AND MOBILE BODY APPARATUS

CROSS REFERENCE TO RELATED APPLICATION

The present application is based on and claims priority of Japanese Patent Application No. 2020-063559 filed on Mar. 31, 2020.

FIELD

The present disclosure relates to a speaker diaphragm used in various audio and video devices, a speaker with the speaker diaphragm, and a speaker diaphragm manufacturing method.

BACKGROUND

Traditionally, as disclosed in Patent Literature (PTL) 1, for materials of speaker diaphragms, it has been a common practice to use materials that include a fabric, a rubber, and an elastomer for an edge and materials that include paper and resin for a diaphragm body.

CITATION LIST

Patent Literature

PTL 1: Japanese Unexamined Patent Application Publication No. 64-896

SUMMARY

However, the speaker diaphragm, and to on, according to PTL 1 can be improved upon.

In view of this, the present disclosure provides a speaker diaphragm, and so on, capable of improving upon the above-described related art.

A speaker diaphragm according to an aspect of the present disclosure includes: an edge formed from an elastomer; and a diaphragm body that is to be joined to the edge, wherein a joint between the edge and the diaphragm body includes a melting portion between the edge and the diaphragm body.

A speaker diaphragm, and so on, according to an aspect of the present disclosure is capable of improving upon the above-described related art.

BRIEF DESCRIPTION OF DRAWINGS

These and other advantages and features of the present disclosure will become apparent from the following description thereof taken in conjunction with the accompanying drawings that illustrate a specific embodiment of the present disclosure.

DESCRIPTION OF EMBODIMENTS

Figure 1:
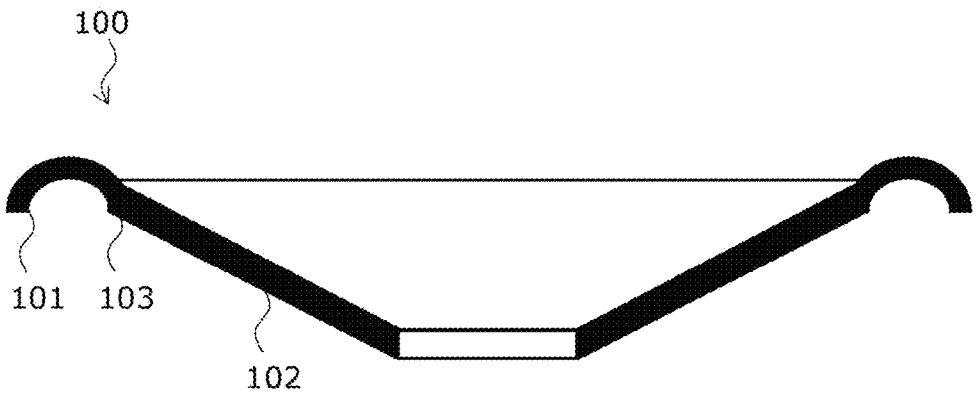
FIG. 1 is a cross-sectional view of a diaphragm according to an embodiment of the present disclosure.

In a related art such as PTL 1, the edge and the diaphragm body are bonded by an adhesive to complete the speaker diaphragm.

In another related art, a fabric and the like of an edge material, which is immersed in advance in thermosetting resin and one side of which is coated with acrylic resin, is hot pressed so that the edge is formed and joined to a diaphragm body at the same time to complete a speaker diaphragm.

With rapid advancement of the digital technology, the performance of audio and video devices has been improved more significantly than that in the past. Accordingly, there is also a strong need in the market for performance improvement of speakers, which are used in the devices and finally emit sounds, such as improvement in the sound pressure level and improvement in sound quality.

In addition, such audio and video devices are widely mounted on means of transportation or the like such as automobiles. Accordingly, weight reduction of speakers is particularly required for fuel saving of automobiles.

In view of the needs as described above, the present disclosure provides a speaker diaphragm, a speaker, and a speaker diaphragm manufacturing method, with which the sound pressure level and sound qualify can be improved as a speaker and weight reduction of the speaker can be achieved.

A speaker diaphragm according to an aspect of the present disclosure includes an edge formed from an elastomer, and a diaphragm body that is to be joined to the edge. Here, a joint between the edge and the diaphragm body includes a melting portion between the edge and the diaphragm body.

According to the configuration of the present disclosure, the speaker diaphragm includes the melting portion between the edge and the diaphragm body. Accordingly, the edge and the diaphragm body can be joined without an adhesive, and therefore the weight of the speaker diaphragm can be reduced.

Since the weight of the speaker diaphragm is reduced, therefore, the sound pressure level of the speaker with the speaker diaphragm can be improved.

Since the sound pressure level of the speaker can be improved, it is also possible to reduce the size of the magnetic circuit, leading to the weight reduction of the speaker.

Furthermore, the melting portion may be a melting portion of the edge.

Furthermore, the diaphragm body may be formed from resin.

Furthermore, the melting portion may be a melting portion of the diaphragm body.

Furthermore, the melting portion may be both a melting portion of the edge and a melting portion of the diaphragm body.

Furthermore, the melting portion may include a portion in which the melting portion of the edge and the melting portion of the diaphragm body fit into each other.

Furthermore, the melting portion may include a portion in which a melting portion of the edge and the diaphragm body penetrate each other.

Furthermore, the diaphragm body may include unevenness in a joint portion with the edge.

Furthermore, the edge may be formed from an elastomer made from a mixed material of (i) an olefin-based material and (ii) a styrene-based material or an ethylene propylene diene monomer (EPDM)-based material.

Furthermore, the edge may be formed from an elastomer having a specific gravity of at least 0.8 g/cm$^3$ and at most 1.1 g/cm$^3$. Furthermore, the edge may include a roll portion having a thickness of at least 0.1 mm and at most 0.5 mm.

A speaker according to an aspect of the present disclosure includes the above-described speaker diaphragm, a magnetic circuit, a frame joined to the magnetic circuit, and a voice coil having one end joined to the speaker diaphragm and the other end disposed in a magnetic gap of the magnetic circuit.

A speaker diaphragm manufacturing method according to an aspect of the present disclosure includes: positioning a diaphragm body to be joined to an edge; and forming the edge by heating and injection molding of a material comprising an elastomer, and joining a melting portion of the edge to the diaphragm body.

An electronic device according to an aspect of the present disclosure includes the above-described speaker, and an amplifier circuit that inputs an electric signal to the speaker.

A mobile body apparatus according to an aspect of the present disclosure includes the above-described speaker, an amplifier circuit that inputs an electric signal to the speaker, and a main body that is mobile and to which the speaker and the amplifier circuit are installed.

Next, exemplary embodiments of a speaker diaphragm, a speaker, and a speaker diaphragm manufacturing method according to the present disclosure will be described with reference to the Drawings.

Embodiment 1

FIG. 1 is a cross-sectional view of a diaphragm according to an embodiment of the present disclosure.

Figure 2:
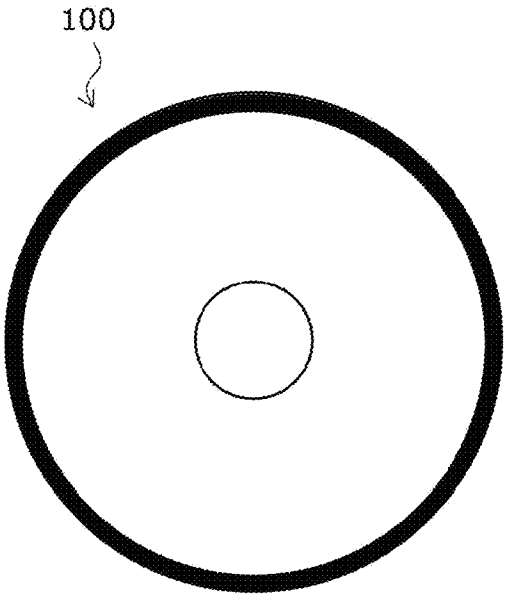
FIG. 2 is a plan view of a diaphragm according to an embodiment of the present disclosure.
Figure 3:
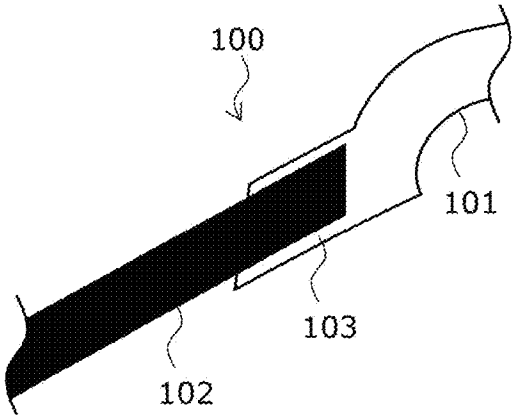
FIG. 3 is a cross-sectional view illustrating, enlarged, a part of the diaphragm according to an embodiment of the present disclosure.
Figure 4:
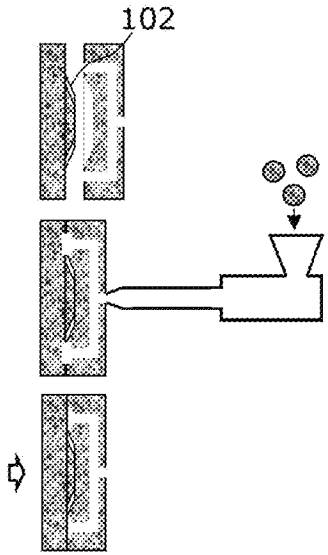
FIG. 4 is a diagram illustrating a method of manufacturing a diaphragm according to an embodiment of the present disclosure.

FIG. 2 is a plan view of a diaphragm according to an embodiment of the present disclosure.

As illustrated in the figures, speaker diaphragm 100 includes edge 101 formed from an elastomer, and diaphragm body 102 to be joined to edge 101.

Here, the joint between edge 101 and diaphragm body 102 includes melting portion 103 between edge 101 and diaphragm body 102.

When a roll-shaped edge is injection molded with thermoplastic elastomer pellets, melting portion 103 serves to join the edge to diaphragm body 102 at the same time to form speaker diaphragm 100.

The manufacturing method of the speaker diaphragm will now be detailed. The method includes: a step of positioning diaphragm body 102 in a mold, diaphragm body 102 being prepared by heating and melting pelleted resin raw materials and injection molded in other steps in advance; a step of injection molding an edge shape by heating and melting pelleted materials formed from an elastomer; and joining melting portion 103 of heated and melted edge 101 to diaphragm body 102 at the same time as the step of molding the edge shape.

Edge 101 is formed from an elastomer made from a mixed material of an olefin-based material and a styrene-based material.

Alternatively, edge 101 may be formed from an elastomer made from a mixed material of an olefin-based material and an ethylene propylene diene monomer (EPDM)-based material.

Thus configured, a light-weight elastomer edge with high productivity can be achieved.

Accordingly, such a light-weight speaker diaphragm can provide a speaker with an increased sound pressure level.

With satisfactory formability and meltability of edge 101, the shape stability of edge 101 can be improved. Further, since melting portion 103 can easily be generated, the bonding strength between edge 101 and diaphragm body 102 can be improved.

Edge 101 may be formed from an elastomer having a specific gravity of preferably at least 0.8 g/cm$^3$ and at most 1.1 g/cm$^3$.

Thus configured, it is possible to achieve an increased sound pressure level and satisfactory frequency characteristics.

When the specific gravity of edge 101 is less than 0.8 g/cm$^3$, edge resonance is likely to occur because of excessively light weight, making it difficult to achieve satisfactory frequency characteristics.

On the other hand, when the specific gravity of edge 101 is larger than 1.1 g/cm$^3$, the sound pressure level is likely to decrease because of excessive weight, making it difficult to improve speaker efficiency.

Edge 101 includes a roll portion having a thickness of preferably at least 0.1 mm and at most 0.5 mm.

Thus configured, it is possible to achieve an increased sound pressure level and satisfactory frequency characteristics with a wide range of sound reproduction.

When the thickness of the roll portion of edge 101 is less than 0.1 mm, edge resonance is likely to occur because of excessive thinness, making it difficult to achieve satisfactory frequency characteristics.

In view of the quality and reliability, the roll portion of edge 101 is easily broken when it is thin, and the shape stability also decreases.

On the other hand, when the thickness of the roll portion of edge 101 is larger than 0.5 mm, the lowest resonance frequency of the speaker increases because of constraint on flexible movement, so that the range of sound reproduction is narrowed.

Description has been made as to the case in which speaker diaphragm 100 is formed by injection molding a roll-shaped edge with thermoplastic elastomer pellets and joining the edge to diaphragm body 102 at the same time.

As described above, in the manufacturing method, since edge 101 is melted to be joined to diaphragm body 102, the joining is possible for both paper and resin for the material of diaphragm body 102.

In addition to the manufacturing method in which edge 101 is melted for joining by using the material as described above, the following may be possible.

An alternative manufacturing method may include forming the diaphragm body from resin and during injection molding of the edge, using the molding heat to melt the diaphragm body so that it is joined to edge to form speaker diaphragm 100.

Here, the type of resin used for the diaphragm body is not limited to polypropylene, which is inexpensive and easily available, and engineering plastics or biodegradable plastics such as polylactic acid for environmental considerations may be used.

Any material that can be heated and melted can be used for joining with the edge and selected as necessary for desired audio characteristics and sound quality.

The melting portion may be both a melting portion of the edge and a melting portion of the diaphragm body.

In this case, since melting portions may be provided to both the edge and the diaphragm body, the bonding strength between the edge and the diaphragm body can be improved.

The melting portion may include a portion in which the melting portion of the edge and the melting portion of the diaphragm body fit into each other. The melting portion may include a portion in which one of the melting portion of the edge and the melting portion of the diaphragm body fit into the other. For example, the melting portion may include a portion in which the melting portion of the edge fits into the melting portion of the diaphragm body. Alternatively, for example, the melting portion may include a portion in which the melting portion of the diaphragm body fits into the melting portion of the edge.

In this case, since both materials are melted to provide such a mutually fit portion, the joint is strengthened mechanically, so that the bonding strength between the edge and the diaphragm body can also be improved.

An example of the case in which the melting portion includes a portion in which the melting portion of the edge and the melting portion of the diaphragm body fit into each other includes the case in which the diaphragm body includes unevenness in a joint portion with the edge.

Thus configured, since the melted edge flows into the unevenness of the diaphragm body during injection molding, the bonding strength can be improved.

As described above, a light-weight high-performance speaker diaphragm with high productivity can be achieved by forming it with the melting portion between the edge formed from an elastomer and the diaphragm body.

Embodiment 2

Next, speaker 300 will be described. Those parts (portions) that produce a similar effect or have a similar function or that have a similar shape or mechanism to those in Embodiment 1 are given the same reference characters and the description thereof may not necessarily be repeated. The following description will be made mainly as to difference from Embodiment 1 and the same description may not necessarily be repeated.

Figure 5:
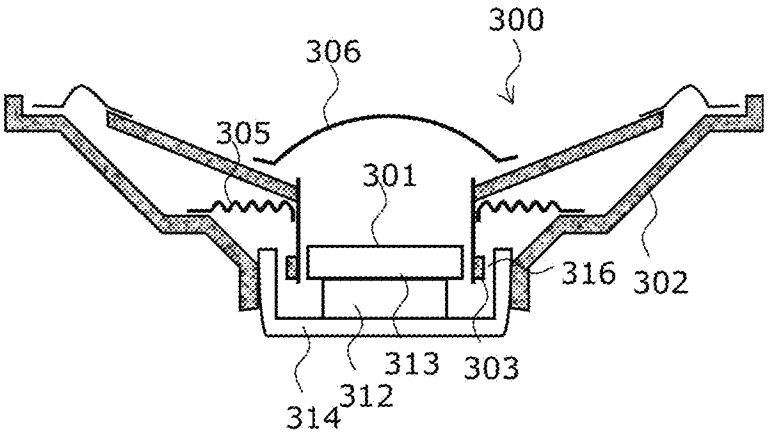
FIG. 5 is a cross-sectional view of a speaker according to an embodiment of the present disclosure.

FIG. 5 is a cross-sectional view of a speaker according to an embodiment of the present disclosure.

As in the figure, speaker 300 includes speaker diaphragm 100, magnetic circuit 301, frame 302, and voice coil body 303.

Magnetic circuit 301 includes cylindrical magnet 312, which is a magnetized permanent magnet, disk-shaped plate 313 attached to the top of magnet 312, bottomed cylindrical yoke 314 containing magnet 312 and plate 313, and has annular magnetic gap 316 between plate 313 and yoke 314.

Frame 302 is a funnel-shaped structural member coupled to yoke 314 of magnetic circuit 301. Speaker diaphragm 100 is disposed at a position surrounded by the upper-end circumference of frame 302, and frame 302 and speaker diaphragm 100 are bonded to each other via edge 101. Center cap 306 is also attached to speaker diaphragm 100 covering a hole in the center of speaker diaphragm 100.

Voice coil body 303 is formed from a cylindrical bobbin and a coil wound around the outer circumference of the bobbin. Voice coil body 303 is disposed such that one end thereof is coupled to the center portion of speaker diaphragm 100 and the other end is within magnetic gap 316 of magnetic circuit 301. Further, voice coil body 303 is supported by damper 305 that connects frame 302 with voice coil body 303 in a bridging manner.

Although a speaker that has an inner magnet-type magnetic circuit 301 has been described above, the present disclosure is not limited thereto and may be applied to a speaker that has an outer magnet-type magnetic circuit.

According to the configuration, as described in Embodiment 1, it is possible to improve productivity of the speaker and the sound pressure level by using a light-weight high-performance speaker diaphragm with high productivity to form the speaker.

Since the sound pressure level of the speaker can be improved, it is also possible to reduce the size of the magnetic circuit, leading to the weight reduction of the speaker.

Embodiment 3

With reference to Embodiment 3, an electronic device to which the present disclosure is applicable will be described.

Figure 6:
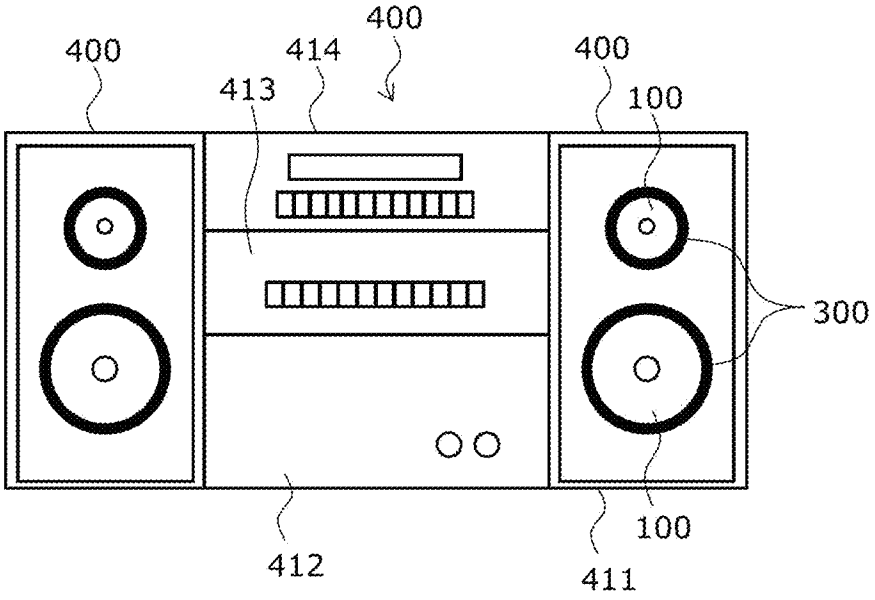
FIG. 6 is a diagram illustrating an external appearance of an electronic device which is an embodiment of the present disclosure.

FIG. 6 is a diagram illustrating an external appearance of an electronic device which is an embodiment of the present disclosure.

In the embodiment, electronic device 400 will be described as an audio mini component system.

Electronic device 400 includes right and left speaker systems 410, each of which includes two speakers 300 incorporated in enclosure 411.

Electronic device 400 also includes amplifier 412 including an amplifier circuit for an electric signal input to speaker system 410, and tuner 413 and audio player 414 that output a source input to amplifier 412.

Electronic device 400, which is an audio mini component system, amplifies a music signal input from tuner 413 or audio player 414 by amplifier 412, and speakers 300 provided in speaker systems 410 emit sound. Specifically, in speaker 300, dynamic magnetism generated by an electric signal input to voice coil body 303 interacts with static magnetism generated in magnetic gap 316 of magnetic circuit 301 to vibrate voice coil body 303 relative to frame 302. The vibration is transmitted to speaker diaphragm 100, which is vibrated to emit sound.

According to the configuration, it is possible to provide electronic device 400 with which improvement of productivity and the sound pressure level, which has not been achieved in the past as described above, can be achieved.

Although an application of speaker 300 to electronic device 400 has been described in terms of an audio mini component system, this is not a limitation. For example, possible applications include audio systems for automobiles, portable audio devices, and the like. Further, a wide variety of applications and developments are possible, including video devices such as televisions, information communication devices such as mobile phones, and electronic devices such as computer related devices.

Embodiment 4

With reference to Embodiment 4, mobile body 500 to which the present disclosure is applicable will be described.

Figure 7:
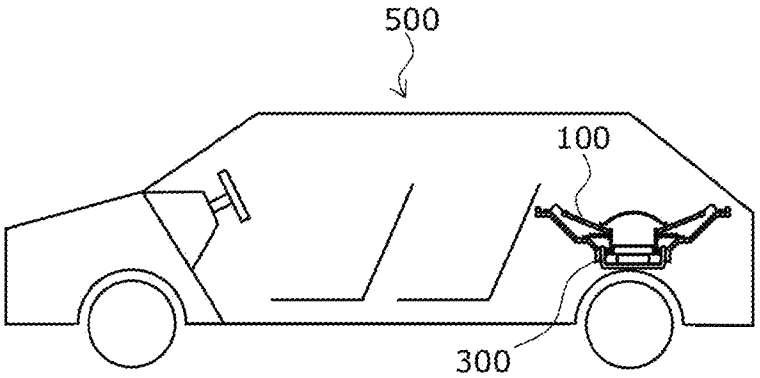
FIG. 7 is a diagram illustrating a mobile body which is an embodiment of the present disclosure.

FIG. 7 is a diagram illustrating a mobile body which is an embodiment of the present disclosure.

In the embodiment, mobile body 500 will be described as an automobile including a body capable of self-propelling.

As in the figure, speaker 300 provided with speaker diaphragm 100 according to the present disclosure is incorporated in a rear tray or a front panel of mobile body 500. Speaker 300 is adapted to emit sound in the mobile body based on a voice signal transmitted from a car navigation or car audio system including an amplifier circuit, which is separately attached to the mobile body.

Speaker 300 thus mounted to mobile body 500 can improve the sound pressure level.

In this way, since the sound pressure level of the speaker can be improved, it is also possible to reduce the size of the magnetic circuit, so that the weight of the speaker can be reduced, contributing to fuel saving of mobile body 500.

While various embodiments have been described herein above, it is to be appreciated that various changes in form and detail may be made without departing from the spirit and scope of the present disclosure as presently or hereafter claimed.

Further Information about Technical Background to this Application

The disclosure of the following Japanese Patent Application including specification, drawings and claims is incorporated herein by reference in its entirety: Japanese Patent Application No. 2020-063559 filed on Mar. 31, 2020.

INDUSTRIAL APPLICABILITY

A speaker diaphragm, a speaker, and a speaker diaphragm manufacturing method according to the present disclosure are applicable to video and audio devices, electronic devices such as information communication devices, and mobile bodies such as automobiles.

The invention claimed is:

1. A speaker diaphragm used in a speaker, the speaker diaphragm comprising:

an edge molded from an elastomer made from a mixed material of (i) an olefin-based material and (ii) a styrene-based material or an ethylene propylene diene monomer (EPDM)-based material; and a diaphragm body having an uneven surface region and including polypropylene having functions of facilitating melting between the edge and the diaphragm body, and improving formability, meltability, and shape stability of the edge, wherein the edge is molded and joined to the uneven surface region of diaphragm body such that a joint between the edge and the diaphragm body is formed and includes a melting portion of a resin between the edge and the diaphragm body, the melting portion of the resin comprising a melting portion of the resin on the edge and a melting portion of the resin on the uneven surface region of the diaphragm body which are melted together by heating and are fit into each other to generate and strengthen the joint, and improves joint strength between the edge and the diaphragm body without an adhesive to the joint, the edge has a specific gravity in a range of 0.8 g/cm$^3$ to 1.1 g/cm$^3$, the edge includes a rolled portion having a thickness in a range of 0.1 mm to 0.5 mm, and the speaker diaphragm achieves lightened weight, increased sound pressure level, satisfactory frequency characteristics with an improved range of sound reproduction, and a reduced size of a magnetic circuit included in the speaker.

2. A speaker, comprising:

the speaker diaphragm according to claim 1;

a magnetic circuit;

a frame joined to the magnetic circuit; and a voice coil having one end joined to the speaker diaphragm and an other end disposed in a magnetic gap of the magnetic circuit.

3. An electronic device, comprising:

the speaker according to claim 2; and an amplifier circuit that inputs an electric signal to the speaker.

4. A mobile body apparatus, comprising:

the speaker according to claim 2;

an amplifier circuit that inputs an electric signal to the speaker; and a main body that is mobile and to which the speaker and the amplifier circuit are installed.

5. The speaker diaphragm according to claim 1, wherein one of the melting portion of the resin on the edge and the melting portion of the resin on the diaphragm body is sandwiched between the other of the melting portion of the resin on the edge and the melting portion of the resin on the diaphragm body.

6. A method of manufacturing a speaker diaphragm used in a speaker, the method comprising:

positioning a diaphragm body having an uneven surface region to be joined to an edge; and molding the edge to have an edge shape by heating a material comprising an elastomer and injection molding the heated such that a melting portion of a resin on the edge is joined to a melting portion of a resin on the uneven surface region diaphragm body to fit into each other by melting together the melting portion of the resin on the edge and the melting portion of the resin on the uneven surface region of the diaphragm body by heating, wherein:

the elastomer is made from a mixed material of (i) an olefin-based material and (ii) a styrene-based material or an ethylene propylene diene monomer (EPDM)-based material, the edge has a specific gravity in a range of 0.8 g/cm$^3$ and to 1.1 g/cm$^3$, the edge includes a rolled portion having a thickness in a range of 0.1 mm to 0.5 mm, the molding of the edge to have the edge shape facilitates melting between the edge and the diaphragm body and improves formability, meltability, and shape stability of the edge, and the fitting into each other generates and strengthens mechanically-bonded joint of the melting portion, and improves joint strength between the edge and the diaphragm body without an adhesive to the joint between the edge and the diaphragm body, and the speaker diaphragm achieves lightened weight, increased sound pressure level, satisfactory frequency characteristics with an improved range of sound reproduction, and a reduced size of a magnetic circuit included in the speaker.

7. The method according to claim 6, further comprising sandwiching one of the melting portion of the resin on the edge and the melting portion of the resin on the diaphragm body between the other of the melting portion of the resin on the edge and the melting portion of the resin on the diaphragm body.

* * * * *